United States Patent [19]

Carpenter

[11] 4,192,151

[45] Mar. 11, 1980

[54] ICE MAKING APPARATUS

[75] Inventor: C. Donald Carpenter, St. Louis, Mo.

[73] Assignee: Vivian Manufacturing Company, St. Louis, Mo.

[21] Appl. No.: 831,296

[22] Filed: Sep. 7, 1977

[51] Int. Cl.[2] ..... F25C 5/02; F25C 5/10

[52] U.S. Cl. ..... 62/320; 62/347; 62/348; 62/352

[58] Field of Search ..... 62/320, 347, 74, 348, 62/349, 352

[56] References Cited

U.S. PATENT DOCUMENTS

| | | | |
|---|---|---|---|
| 2,150,229 | 3/1939 | Leopold | 62/74 |
| 2,637,177 | 5/1953 | Reedall | 62/352 X |
| 2,730,865 | 1/1956 | Murdock | 62/352 X |
| 2,870,612 | 1/1959 | Garland | 62/320 X |
| 2,995,017 | 8/1961 | Breeding | 62/344 X |
| 2,997,861 | 8/1961 | Kocher et al. | 62/352 |
| 3,423,952 | 1/1969 | Pugh | 62/347 X |
| 3,430,452 | 3/1969 | Dedricks et al. | 62/347 X |
| 3,456,452 | 7/1969 | Hilbert | 62/59 |
| 3,546,896 | 12/1970 | Hagen et al. | 62/74 X |

*Primary Examiner*—Leslie Braun

*Attorney, Agent, or Firm*—Burns, Doane, Swecker & Mathis

[57] ABSTRACT

An apparatus and a method for making ice are disclosed wherein ice forms on two sides of a plurality of freezing plates which are vertically arranged within a housing. A water distribution chamber positioned immediately above the freezing plates includes a plurality of inverted "V" shaped ridges in a bottom portion thereof. Each ridge corresponds to one of the plurality of freezing plates and includes a series of orifices arranged to direct water onto each side of the corresponding freezing plate. At the bottom of each freezing plate is a plastic strip which prevents ice slabs from the two sides of the plate from joining together at the bottom. Beneath the ice plates is a rotating sizer which fractures the ice slabs from the plates into pieces having a predetermined maximum size. The pieces fall through the sizer onto a screw conveyor which cooperates with a perforated lower housing to remove small undesirable ice pieces from the fractured ice. The small ice pieces pass through the lower housing into a collection tank connected to the water distribution chamber by a pump and are effective to precool the water.

A refrigerating and defrosting system having a compressor and a condenser is connected to the freezing plates by a conduit system. The ice slabs are formed during a refrigeration portion of the operating cycle, cold refrigerant fluid flows through a passageway within each freezing plate. During a defrosting portion of the operating cycle, hot refrigerant fluid is supplied directly by the compressor to the freezing plates. A suction line solenoid valve is provided for the freezing plates to interrupt the flow of hot refrigerant fluid during the defrosting portion and to increase the pressure and temperature of the hot refrigerant fluid to enhance loosening of the ice slabs.

9 Claims, 6 Drawing Figures

| MINUTES | WATER PUMP 75 | (MOTOR 34) ICE SIZER | SOLENOID VALVES LIQUID LINE 120 | DEFROST GAS 130 | SUCTION LINE 124 | |
|---|---|---|---|---|---|---|
| | ON | OFF | ON | OFF | ON | REFRIGERATION CYCLE |
| 0 | ON | OFF | ON | OFF | ON | DEFROST CYCLE |
| 1 | OFF | OFF | OFF | OFF | ON | " " |
| 1.5 | OFF | ON | OFF | ON | ON | " " |
| 2.5 | OFF | ON | OFF | ON | OFF | " " |
| 3.5 | ON | OFF | ON | OFF | ON | REFRIGERATION CYCLE |

ICE MAKING APPARATUS

BACKGROUND OF THE INVENTION

The present invention relates to making ice. More specifically, the invention concerns a method and an apparatus for making a supply of fragmented, clear ice from one or more vertically arranged freezing plates.

One of the more practical methods of making large quantities of ice is to make large slabs of ice and then break the slabs into smaller pieces of a useable size. To create the ice slabs, vertical freezing plates may be used on which the ice slabs are formed by internally cooling the plates. The ice slabs are then loosened from the freezing plates.

Various ice making machines are in use today which utilize one or more generally planar ice plates for forming ice slabs that are subsequently broken into smaller pieces. An example of such an ice making machine is described in U.S. Pat. No. 2,995,017 issued to Breeding. Other ice making machines are utilized to form ice on structures having a variety of shapes such as pipes and molds and are found to be described in U.S. Pat. No. 3,430,452 issued to Dedriks et al; U.S. Pat. No. 2,870,612 issued to Garland and U.S. Pat. No. 2,637,177 issued to Reedall.

In the known prior art devices, however, water distribution systems have not been wholly adequate. For example, some devices use a water manifold connected with a plurality of perforated tubes to distribute water to be frozen. In such devices, the pressure drop in the tubes causes a maldistribution of water on the plates which causes non-uniform ice slab thickness and non-uniform ice quality.

It has also been difficult to obtain clear ice pieces that are generally uniform in size and free of small ice particles (often referred to as "snow"). In part this difficulty is due to the inability of prior art devices to segregate snow from large ice particles.

Typically, prior art ice making devices freeze water to make ice and then heat, in some manner, the surface on which the ice has formed so as to loosen or defrost the ice. In some devices, water is also used for defrosting purposes. When water is used for defrosting, the water must have a temperature of at least 65° F. Accordingly, an auxiliary water heater and a blending valve are often part of an ice making machine.

In view of the kinds of problems discussed above, it will be apparent to those skilled in the art that there continues to exist a need for an ice making machine which overcomes those kinds of problems, as well as others.

Accordingly, it is an object of the present invention to provide a novel apparatus for making high quality, clear ice on both sides of a freezing plate to which water is supplied in a uniform manner.

It is another object of the present invention to produce ice of a generally uniform size which is substantially free of very small ice particles.

Yet another object of the present invention is to provide a novel apparatus for making ice in which snow removed from fragmented ice is recycled to precool water that is later to be frozen.

Still another object of the present invention is to use hot refrigerant gas directly from a compressor of the apparatus to defrost the ice plates and also to pressurize this hot refrigerant gas to further defrost the ice.

Yet still another object of the present invention is to provide a novel ice making apparatus having a plurality of vertically oriented ice plates arranged closely adjacent one another and including water distribution, ice sizing and removal features which cooperate with the arrangement of the ice plates to provide an ice making machine which produces a large volume of ice within a compact housing.

SUMMARY OF THE INVENTION

In accordance with the present invention, an ice making machine includes a freezing plate having an internal refrigerant passage and external surfaces to which water is supplied from a distributing device. The distributing device includes a bottom portion having an inverted V-shaped ridge positioned above an edge of the freezing plate. The ridge includes openings adapted to direct water to each external surface of the freezing plate in such a manner that the water is essentially uniformly distributed and entrained air bubbles are liberated. In this manner, a slab of ice having generally uniform thickness and superior clarity is obtained.

In order to break the ice slabs into small pieces, a sizing device is positioned beneath the freezing plate so as to fracture the ice slab and produce ice pieces having a predetermined maximum size. Due to the nature of ice, pieces smaller than the predetermined size will also result from operation of the sizing device.

An ice conveying device is disposed below the sizing device for moving ice from the machine and for separating ice pieces smaller than a predetermined minimum size. The conveying device delivers ice pieces larger than the predetermined minimum size and smaller than the predetermined maximum size for use. In addition, the conveying device agitates the ice pieces and urges those ice pieces smaller than the predetermined size to drop into a water supply tank positioned therebelow. These small ice pieces precool water in the supply tank.

A circulating device communicates with the water supply tank so as to deliver water to the distributing device.

To properly cool the freezing plate, a refrigeration system is provided and is connected with the internal refrigerant passage of the plate. The refrigeration system supplies cold refrigerant to the plate for freezing water and forming an ice slab. The refrigeration system is suitably controlled so that the refrigerant fluid can be used to defrost the ice slabs from the plate surfaces by directing hot refrigerant fluid to the passage.

In addition, a valve on the discharge side of the internal refrigerant passage is operated to interrupt flow of the hot refrigerant fluid so that its pressure and temperature increase to enhance the defrosting action. The length of time required for defrosting or harvesting ice is substantially reduced by this pressure and temperature increase. The temperature increase not only avoids the necessity of using hot water to defrost but also is capable of effecting the defrost in less than a minute. Accordingly, more freezing/harvesting cycles can be accomplished in a given period of time.

The freezing plate may also be provided with an insulated strip on the bottom edge. This strip is effective to prevent the ice slabs formed on the parallel surfaces of the freezing plate from becoming a single U-shaped slab which would be difficult to remove.

To enhance clarity of the product ice, the surfaces of the freezing plate may be embossed so as to generate turbulence in the water passing over the freezing plate.

This turbulence augments liberation of entrained air from the water passing over the plate thereby reducing the level of opaqueness in resulting ice.

To adjust the thickness of the ice produced, the length of the freezing cycle can be varied as desired merely by adjustment of a timer.

BRIEF DESCRIPTION OF THE DRAWINGS

The above as well as many other objects and advantages will be apparent to those skilled in the art when this specification is read in conjunction with the accompanying drawings wherein like reference numerals have been applied to like elements and wherein.

DESCRIPTION OF THE PREFERRED EMBODIMENT

Figure 2:
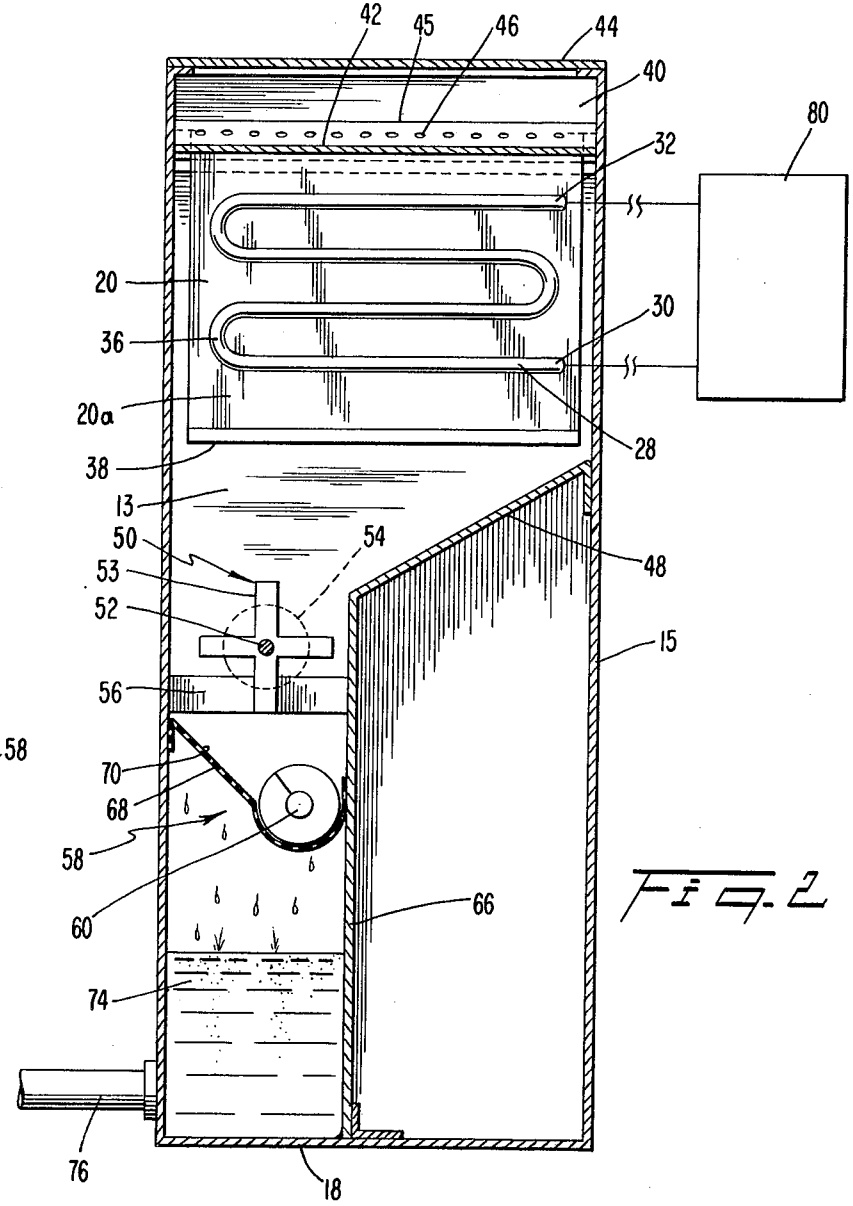
FIG. 2 is a partial cross-sectional view taken along the line 2—2 of FIG. 1.
Figure 1:
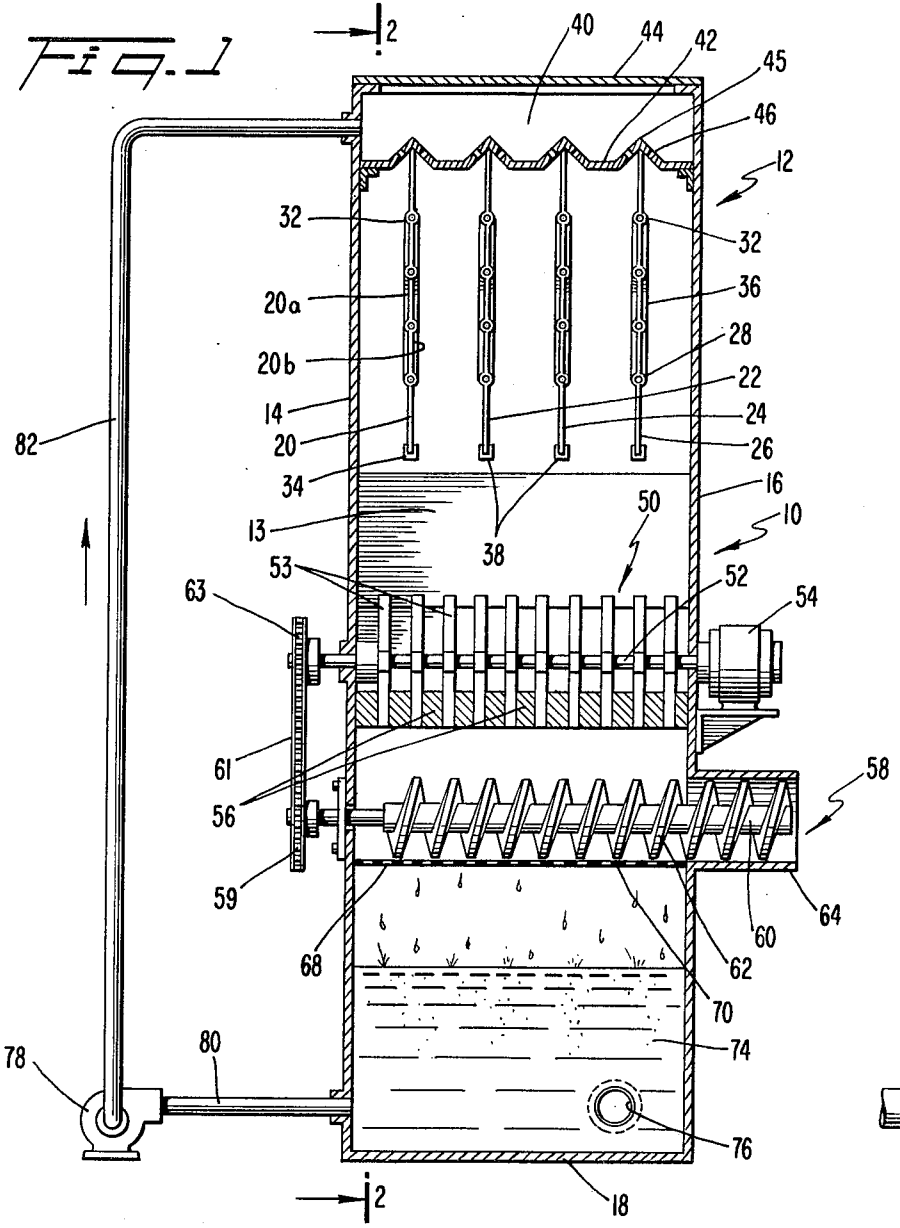
FIG. 1 is a partial cross-sectional view of an ice making machine of the present invention.

With reference to FIG. 1 of the drawings, an ice making machine 10 according to the present invention includes an outer housing or enclosure 12 having a pair of side walls 14, 16 and a bottom wall 18. A front wall 13 and a back wall 15 (see FIG. 2) are each secured to both side walls 14, 16 and to the bottom wall 18 to complete the apparatus enclosure 12. Positioned between the side walls 14, 16 (see FIG. 1) and within an upper portion of the enclosure 12 are a plurality of identical ice freezing plates 20, 22, 24, 26.

The freezing plates are identical and it will suffice to describe one plate in detail. Each freezing plate is arranged in a generally vertical orientation parallel both to each other freezing plate and to the side walls 14, 16. Each ice plate 20, 26 has a generally planar structure with a pair of external planar surfaces **20*a*, 20*b* and an internal refrigerant passageway 28. The passageway 28 (see FIG. 2) runs in a tortuous or serpentine path through a plane of the freezing plate. In addition, the passageway 28 of each plate 20 has an inlet 30 which may be provided at a lower portion of the freezing plate and an outlet 32 which may be located at an upper portion thereof. Each generally planar external surface 20*a*, 20*b* of the freezing plate may include a raised or embossed region 36 (see FIG. 1) overlying the passageway 28. The raised region 36 enables the freezing plate to accommodate a tubular passageway 28 having a predetermined diameter that exceeds the typical thickness of the freezing plate 20** without requiring the plate thickness to be greater than the diameter of the passageway.

Figure 3:
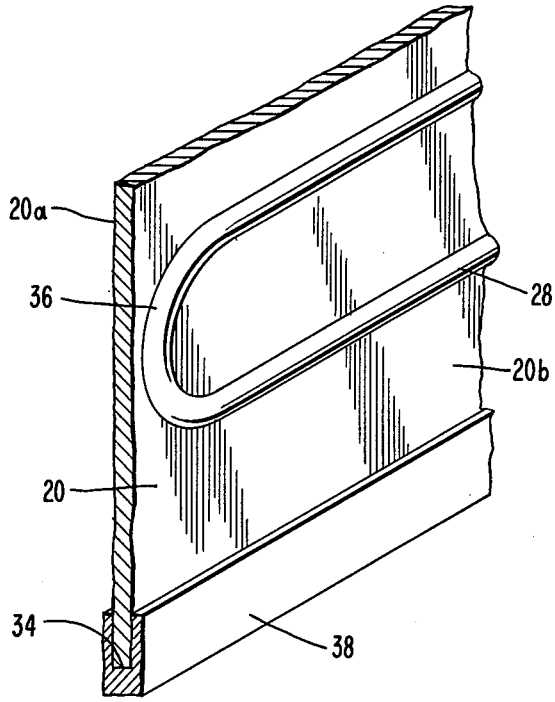
FIG. 3 is an enlarged detail view in perspective of a lower portion of a freezing plate of the ice making machine showing a strip of material provided along a lower edge thereof.

Each freezing plate may be fabricated of type 316 stainless steel or other suitable material and may, for example, be a Trainer Corporation Style 50 freezing plate. Along a bottom edge 34 (see FIG. 3) of each freezing plate 20 is a barrier strip 38 formed of a material, such as plastic, having a low heat transfer coefficient. The barrier strip has a generally U-shaped cross section and extends along substantially the entire edge 34. The low thermal conductivity of the barrier strip prevents ice slabs that form on both sides **20*a*, 20*b* of the ice plate 20 from freezing together at the bottom of the ice plate 20** and making a unitary ice slab.

Figure 4:
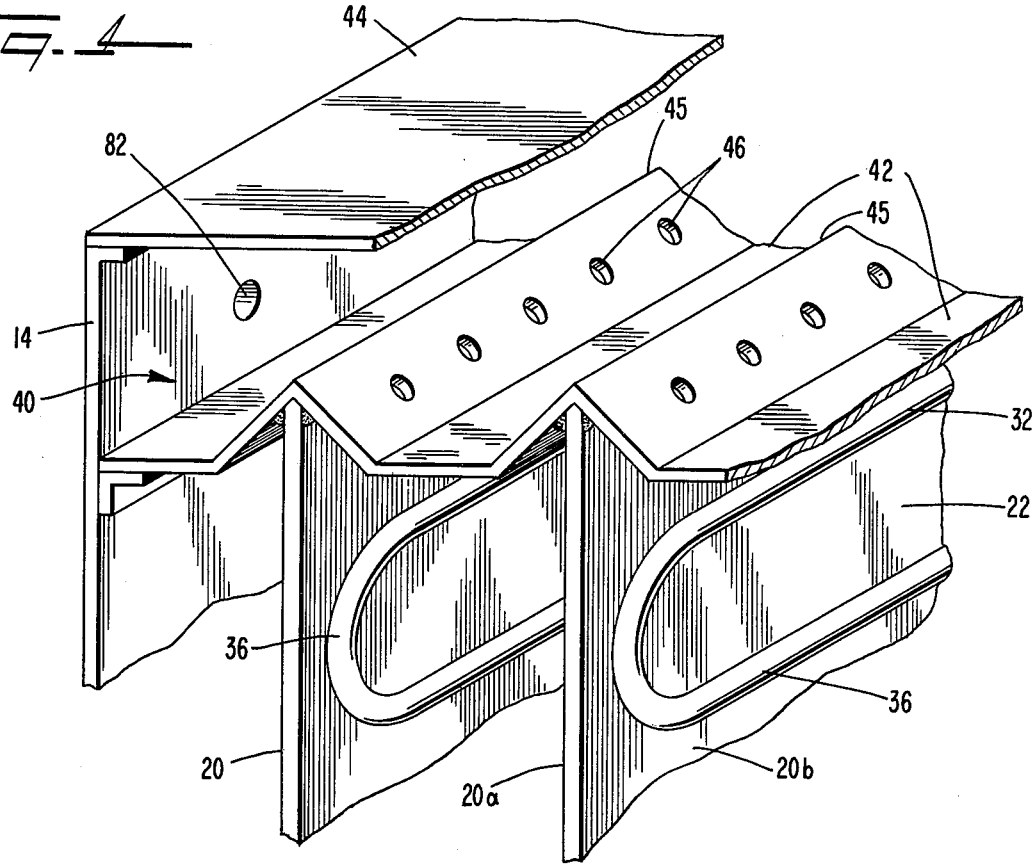
FIG. 4 is an enlarged perspective view of an upper portion of a freezing plate and a portion of a water distribution chamber with portions broken away for the sake of clarity.

Positioned immediately above the ice plates 20, 22, 24, 26 (see FIG. 1) and at the upper portion of the walls 13, 14, 15, 16 is a water distribution assembly 40 including a bottom member 42 and a removable cover 44. The water distribution assembly 40 supplies water to the planar surfaces **20*a*, 20*b* of each of the freezing plates during a portion of the operating cycle. The bottom member 42 has a plurality of inverted "V" shaped regions 45, each corresponding and aligned parallelly with an upper edge 43 of a corresponding freezing plate 20** (see FIG. 4).

A series of small holes 46 are arranged linearly along each side 47 of the inverted "V" shaped regions to supply each side **20*a*, 20*b* of the freezing plate with water. The water may flow onto the freezing plate substantially by the force of gravity or internal pressure within the water distribution assembly 40. Moreover, since the holes 46 all communicate with the distribution chamber 40 without conduits of varying length therebetween, there is essentially no pressure difference between the holes 46 supplying one plate 20 or between the holes of different plates. Accordingly, the water flow from each hole 46 is essentially the same and water is distributed uniformly on each side of the plate 20 and uniformly on each of the plates 20, 22, 24, 26**.

The linear arrangement of the holes above the freezing plates eliminates any pressure differentials between holes 46 that may be associted with the different hole elevations. As water passes from the holes at low velocity, little splashing occurs and the water spreads and flows downwardly across the plate surfaces **20*a*, 20*b*. The passage of water over the raised portions 36 of the freezing plate 20** results in water turbulence which augments liberation of entrained air and is particularly important in obtaining a high degree of clarity in the ice formed by the apparatus of the present invention.

Located beneath the plurality of freezing plates (see FIG. 2) is a guide member 48 which is inclined downwardly toward a sizing device 50. When an ice slab is defrosted from one of the freezing plates, the ice slab falls either directly onto the sizing device 50 or onto the guide member 48. Gravity urges any ice on the guide member 48 toward the sizer 50.

The rotatable sizing device 50 (see FIG. 1) includes a shaft 52 which is driven by a motor 54. The shaft 52 extends between the side walls 14, 16, is rotatably supported by the side walls 14, 16 and is oriented generally perpendicularly to the planes of the freezing plates 20, 22, 24, 26. A plurality of radial vanes 53 are carried by the shaft 52 and extend outwardly therefrom. The vanes 53, when rotating, engage the ice slabs, break the slabs and urge the ice toward an array of sizing bars 56. The sizing bars 56 extend between the front wall 13 and an intermediate wall 66 at a location beneath the shaft 52. The sizing bars 56 provide a grid with spaces through which the vanes 53 of the sizer rotate to further break the ice. As the ice sizer 50 rotates, large pieces of ice are prevented from passing through the grid by the spacer bars 56 and are broken to a smaller size by interaction of the vanes 53 with the bars 56. The bars 56 thus define a predetermined size for the ice which passes through the grid.

A conveying device such as a rotary screw conveyor 58 is provided vertically beneath the sizing device 50 to remove the sized ice pieces away from the apparatus 10. The screw conveyor 58 includes a shaft 60 extending between the side walls 14, 16 and being generally parallel to the shaft 52 of the sizing device 50. A helical flange 62 is mounted on the shaft 60 to urge the ice particles in a direction along the shaft and out through an exit portal 64, provided in the side wall 16.

To drive the screw conveyor 58, an end of the screw shaft 60 is provided with a driven sprocket 59 which is driven by a chain 61 or other suitable means that, in turn, is driven by a driving sprocket 63. The driving sprocket 63 is attached to an end of the sizer shaft 52 and is rotated by the motor 54. Accordingly, the motor 54 drives both the sizer 50 and the conveyor 58. Of course, other driving arrangements are also within the scope of the invention.

Beneath the screw conveyor 58 (see FIG. 2) is a perforate screen 68 which extends between the front wall 13 and the intermediate wall 66. The perforate screen 68 includes a multiplicity of openings 70 which permit ice particles smaller than a predetermined minimum size to pass through the screen 68. Some of these smaller ice particles are commonly referred to as "snow" and are frequently undesirable. The "snow" as well as the other ice particles smaller than the predetermined minimum size pass through the perforate screen and drop into a water tank 74 formed in the bottom of the apparatus 10 by the side walls 13, 14, 16, 66 and the bottom 18. The small ice pieces melt in the water tank 74 and thereby precool water therein.

The perforate screen 68 also allows water, which is supplied to the surfaces of the freezing plates 20, 22, 24, 26 but which is not frozen into slabs of ice thereon to drip off of the freezing plates and be collected in the water tank 74. Additional water may be supplied to the water tank 74 through an inlet 76 provided in the front wall 13. The inlet 76 may be connected to a supply water line and may include a suitable conventional float valve (not shown) to maintain a predetermined level of water in the tank 74.

A circulating pump 78 (see FIG. 1) communicates with the water tank 74 and includes an inlet connected to the tank 74 by way of a conduit 79. Another conduit 82 connects the outlet of the pump 78 with the water distribution assembly 40. In this way, water which has been cooled by the snow supplied by the screw conveyor 58 is supplied to the distribution chamber 40.

A refrigerating and defrosting system 80 for the ice making apparatus 10 is connected with the inlet 30 of each freezing plate as well as to the outlet 32. The system 80 operates on a refrigerant fluid, preferably a refrigerant gas, and includes (see FIG. 5) a compressor 100 having an inlet 104 and an outlet 102. The compressor 100 is of conventional design and is operable to compress a suitable refrigerant fluid such as R-12 (dichloro-difluromethane), R-22 (monochlorodiflurometh-ane), R-502 or R-717 (ammonia). When leaving the compressor outlet 102 the refrigerant fluid comprises a relatively hot high pressure refrigerant gas which is supplied to an inlet of a condenser 108 by a conduit 106. The condenser 108 cools the hot high pressure refrigerant gas, condenses the gas to a liquid, and supplies the cooler high pressure refrigerant liquid to a heat exchanger coil 110 of a suction line accumulator 112. After leaving the coil 110 through a conduit 116, refrigerant liquid passes through a dryer 114. A valve 117 may be provided between the coil 110 and the outlet of the condenser to permit a manual interruption of the supply of refrigerant to the coil.

Upon leaving the dryer 114, the high pressure refrigerant liquid passes through a solenoid control valve 120 and an expansion valve 118, which reduces the pressure and cools the refrigerant liquid. After leaving the expansion valve 118, the cold low pressure refrigerant liquid is supplied to distributor 121 which delivers cold low pressure refrigerant fluid to each of the freezing plates and may introduce a second pressure drop in the refrigerant flow. A check valve 132 is provided for each of the freezing plates to prevent a passage or throttled refrigerant fluid from bypassing into neighboring plates. As the cold refrigerant fluid (which may now be a mixture of liquid and gas) flows through the passgeway of each freezing plate 20, 22, 24, 26, it cools the corresponding plate sufficiently to freeze the water passing over the external surfaces, supplied by the water distribution assembly .

The cold refrigerant fluid absorbs heat from both the water and the ice plates and leaves the freezing plates 20, 22, 24, 26 by a common suction line 122. Between each plate and the suction line 122 is a suction line solenoid valve 124. Alternately, a single solenoid valve (not shown) may be used at the entrance to the suction line 122. The refrigerant fluid is conducted by the return line 122 to the suction line accumulator 112. In the suction line accumulator 112, refrigerant fluid in line 122 absorbs heat from the pressurized refrigerant liquid leaving the condenser 108 and refrigerant liquid separates from refrigerant gas. The refrigerant gas then passes from the accumulator 112 to the compressor inlet 104.

This refrigeration portion of the cycle may continue for up to about one hour, the preferred length of time being about one half hour. A suitable adjustable timer may be used to determine the exact length of time during which freezing occurs. Accordingly, the thickness of ice slabs formed on the freezing plates can be predetermined and adjusted, as required.

After the length of time has elapsed, two ice slabs have formed on each plate 20, 22, 24, 26 and are ready to be defrosted for sizing into the desired range. To defrost the ice slabs, the solenoid valve 120 closes thereby interrupting the supply of cold refrigerant fluid to the freezing plates 20, 22, 24, 26. The refrigerant fluid is, however, still being removed from the freezing plates through the suction line solenoid valves 124.

Refrigerant gas is continuously supplied to the compressor inlet 104 through a refrigerant suction bypass valve 142 provided in a bypass conduit 126. The bypass conduit 126 communicates with the compressor outlet 102 and the return line 122 so that refrigerant gas can be bypassed to the compressor inlet 104 when refrigerant pressure drops below a preset pressure of the bypass valve 142. A manually operated valve 128 provided in the conduit 126 is operable to interrupt the supply of hot refrigerant gas to the bypass valve 142. However, the valve 128 is normally open so that the bypass valve 142 provides refrigerant gas to the compressor inlet 104 during periods when the solenoid valve 120 and/or the suction line solenoid valve are closed.

With freezing plates free of cold refrigerant fluid, a defrost gas solenoid valve 130 opens to supply hot refrigerant gas from the compressor outlet 102 to the passageway of each freezing plate 20, 22, 24, 26. The freezing plates are heated by a temperature near the freezing temperature of water by hot refrigerant gas which passes through the freezing plates, the suction solenoid valves 124 and returns to the compressor inlet 104 by way of the return conduit 122.

After the hot refrigerant gas from the compressor 100 has passed directly through the freezing plates 20, 22, 24, 26 for a period of time, the suction line solenoid valves 124 are closed thereby interrupting the flow of hot refrigerant gas to the return conduit 122. Consequently, the refrigerant pressure within the passageway of each freezing plate increases. The refrigerant pressure increase in the freezing plates 20, 22, 24, 26 is accompanied by a refrigerant temperature increase in accordance with classical thermodynamic considerations thereby further heating the plates to defrost the ice slabs therefrom. This augmentation of the refrigerant fluid temperature thus accelerates the defrosting process.

Of course, throughout the period of time when the suction line solenoid valves 124 are closed, and the refrigerant system is below the predetermined relief pressure of the bypass valve 142 refrigerant gas is continuously being supplied to the compressor inlet 104 by way of the bypass conduit 126 and the bypass valve 142.

Figures 5, 6:
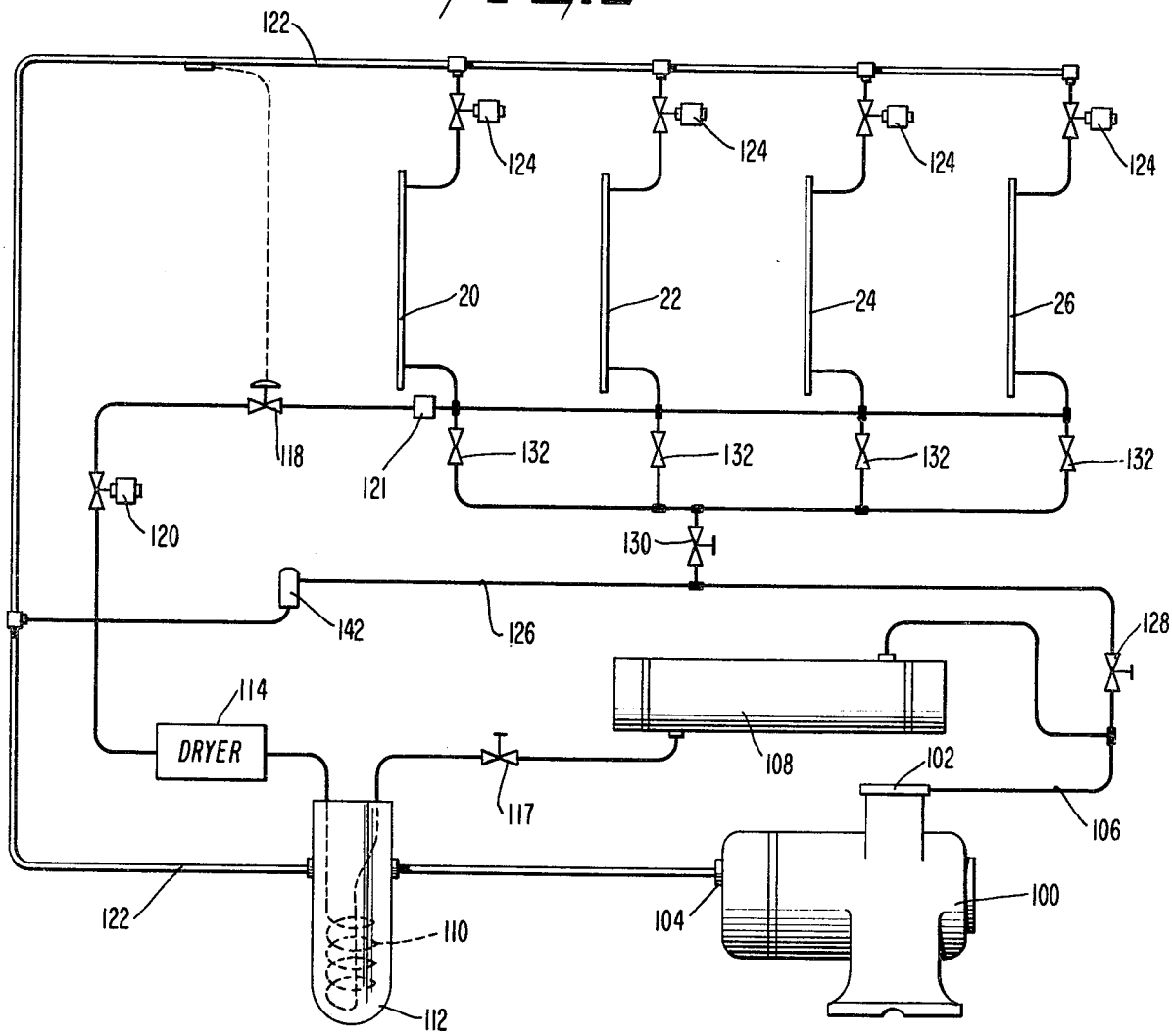
FIG. 5 is a schematic illustration of the refrigerating and defrosting system of the ice making machine.
FIG. 6 is a valve timing schedule for the ice making machine.

A typical timing schedule for operating the water supply apparatus and the refrigeration and defrosting system is shown in FIG. 6. Generally speaking, the ice making apparatus operates in a cycle: during a first portion of the cycle which may, for example, last one-half hour, water is supplied to the freezing plates 20, 22, 24, 26 (see FIG. 1) while cold refrigerant fluid cools the plates to freeze the water; during a subsequent portion of the cycle, hot refrigerant gas defrosts the ice slabs from the plates.

In operation (see FIG. 1), at the beginning of an operating cycle the water pump 78 is turned on to circulate water from the supply tank 74 to the water distribution assembly 40 at the top of the machine 10. The water flows at an essentially uniform flow rate through the holes 46 in the inverted V-shaped ridges 45 and then flows down both external surfaces of the freezing plates 20, 22, 24, 26.

While the water is flowing over the freezing plate surfaces, the refrigerant supply valve 120 (see FIG. 6) is opened so that cold refrigerant fluid from the throttling valve 118 passes through the passageway 36 (see FIG. 2) of each freezing plate. The cold refrigerant fluid freezes the water on the outside of the plates forming an ice slab on each planar surface thereof. The two ice slabs formed on each of the freezing plates 20, 22, 24, 26 are prevented from being united along the bottom edge 34 of each plate by the presence of the corresponding insulating strip 38. In this manner the ice slabs are more readily defrosted from the plates 20, 22, 24, 26.

As the water flows down the plates, turbulence generated by the plate surfaces enhances liberation of dissolved air so as to produce ice of outstanding clarity. The flow of water and cold refrigerant fluid to the freezing plates 20, 22, 24, 26 (see FIG. 6) continues until the ice slabs reach a predetermined thickness.

At this point, the defrosting portion of the operating cycle commences: the refrigerant supply valve 120 closes interrupting the flow of cold refrigerant fluid to the freezing plates 20, 22, 24, 26. Since the compressor 100 is continuously operating, remaining refrigerant fluid is evacuated from the plates by the compressor. The water pump 78 (see FIG. 1) still continues to supply water to the distribution assembly 40.

When a period of about one minute has elapsed, the pump 78 is turned off so that only the water remaining in the distribution assembly can flow onto the freezing plates 20, 22, 24, 26.

After another period of about one half minute elapses, the motor 54 is switched on so that the sizing device 50 and the conveying assembly 58 are operating. Simultaneously, the defrost gas solenoid valve 130 opens so that hot refrigerant gas flows through each of the freezing plates so as to melt the portion of each ice slab immediately adjacent to the plate, thereby defrosting and loosening the bottom section of each ice slab from each plate.

Subsequently, after another period of about one minute, the suction line solenoid valves 124 associated with each freezing plate 20, 22, 24, 26 close causing refrigerant pressure to increase. Concurrently with the pressure increase, there is a temperature increase in the refrigerant gas which further heats the plates to release the upper section of each ice slab from the associated plate and complete the defrost.

As the ice slabs are loosened or harvested from the ice plates 20, 22, 24, 26 (see FIG. 1), the ice slabs drop downwardly and are engaged by the rotating sizing assembly 50. The vanes 53 carried by the rotating sizing shaft 52 hit the ice slabs and begin to break the ice slabs into smaller pieces. If the ice pieces are too large to pass through the grid defined by the bars 56, the vanes 53 cooperate with the bars to further break the ice pieces. Thus, the ice slabs are broken into smaller pieces of ice having a predetermined maximum size.

When the ice pieces are properly sized, they drop through the bars 56 and into the conveying assembly 58 which moves them to the discharge portal 64. As the screw conveyor 62 of the conveying assembly 58 moves the ice pieces, it agitates the ice pieces so that those ice pieces smaller than a predetermined minimum size pass through the openings 70 of the perforate screen 68.

In this manner, the ice pieces delivered from the portal 64 have both a predetermined maximum size and a predetermined minimum size. Moreover, small ice particles such as "snow" are effectively separated from the desired ice pieces.

Those pieces of ice which are smaller than the predetermined size, drop through the openings 70 and fall into the water tank 74 where they precool the water to be frozen.

With the sized pieces of ice delivered from the portal for use, the refrigeration or freezing portion of the operating cycle commences again. Accordingly, the pump 78 is turned on, the motor 54 is turned off, the defrost supply valve 120 is opened and the suction line solenoid valves 124 are opened. As water begins to traverse the plates, if its does not freeze, it drips down into the supply tank 74 so as to effect additional precooling of the supply water.

Any suitable conventional control for operating the solenoid valves 120, 124, 130, the pump 78 and the motor 54 in the appropriate timed sequence may be used.

Using the apparatus of the present invention, the ice slabs can be harvested from the freezing plates in times heretofore unattainable. Prior art devices required harvesting times on the order of ten minutes, whereas, with the present invention, harvesting times on the order of one minute or less are easily attained. This time saving is reflected in the increased ice producing capacity of the machine.

Moreover, by using simple solenoid valves and timing devices, the freezing cycle and thus the ice thickness can be quickly and easily varied. This feature being in stark contrast to device requiring gear set changes in order to effect cycle time variation.

In addition, the ice sizing and conveying apparatus enables the product ice to be free of objectionable snow in addition to be within a prescribed size range.

It will now be apparent that there has been provided in accordance with this invention a novel method and apparatus for making ice which fulfills the objects and advantages set forth hereinabove. Moreover, it will be apparent to those skilled in the art that there are numerous modifications, variations, substitutions and equivalents of the features of this invention which do not depart from the spirit and scope of this invention. Accordingly, it is expressly intended that all such modifications, variations, substitutions and equivalents which fall within the spirit and scope of this invention as defined by the appended claims be embraced thereby.

What is claimed is:

1. Apparatus for making clear ice, comprising:

plate means for forming ice sheets including, a pair of vertically oriented outer surfaces, the outer surfaces being generally planar and having an embossed pattern thereon, and a passageway including an inlet and an outlet, the passageway extending between the outer surfaces of the plate means in a generally tortuous path;

water distribution means for distributing water to the plate means including, chamber means for holding water, having a bottom member with an inverted "V" shaped portion being positioned above the plate means in close proximity thereto, the inverted "V" shaped portion having a plurality of orifices disposed throughout to provide a generally uniform flow rate of water from the chamber onto the outer surfaces of the plate means while avoiding entrainment of air into the water, tank means provided below the plate means for collecting excess water from the outer surfaces of the plate means, and a pump having an inlet in communication with the tank means and an outlet in communication with the chamber means;

sizing means provided between the plate means and the tank means for breaking ice sheets formed on the outer surfaces of the plate means into ice pieces having a predetermined maximum size;

conveying means provided between the sizing means and the tank means for removing the ice pieces from the apparatus; and refrigerating and defrosting means for supplying a refrigerant fluid for icemaking and defrosting to the passageway of the plate means to loosen ice therefrom, including a compressor for pressurizing and raising the pressure and temperature of refrigerant fluid, having an inlet and an outlet, a condenser for lowering the temperature of compressed refrigerant fluid, having an inlet and an outlet, the condenser inlet being in fluid communication with the compressor outlet, and conduit means for connecting the plate means outlet with the compressor inlet, selectively operable for connecting the condenser outlet with the plate means inlet during water freezing, and for connecting the compressor outlet with the plate means inlet during ice loosening, the refrigerating and defrosting means further including a valve provided in the conduit means between the plate means outlet and the compressor, immediately downstream of the plate means outlet and operable between open and closed positions, the open position permitting a flow of refrigerant fluid through the passageway of the plate means and the closed position preventing a flow of refrigerant fluid to increase pressure of the refrigerant fluid within the ice plate means, the pressure acting on the surfaces of the plate means to defrost the ice from the outer surfaces.

2. The apparatus of claim 1 wherein the plate means includes a plurality of ice plates, each plate having a corresponding pair of vertically oriented outer surfaces and wherein the chamber means includes a corresponding plurality of inverted "V" shaped portions, so as to increase the quantity of ice produced.

3. The apparatus of claim 2, wherein the refrigerating and defrosting means further includes a corresponding plurality of valves operable between open and closed positions, each valve associated with a corresponding one of the plurality of ice plates and provided in the conduit means between the corresponding ice plate outlet and the compressor inlet, the open position of each valve permitting a flow of refrigerant fluid through the corresponding ice plate and the closed position of each valve preventing a flow of refrigerant fluid through the corresponding ice plate to increase pressure of the refrigerant fluid therein.

4. The apparatus of claim 3, wherein the refrigerating and defrosting means further includes a bypass providing communication between the compressor inlet and the compressor outlet to supply refrigerant fluid to the compressor inlet when the plurality of valves are each in the closed position.

5. The apparatus of claim 2, wherein each ice plate includes a lower portion having a strip of material of low thermal conductivity to inhibit a formation of ice along the lower portion.

6. The apparatus of claim 5 wherein the strip of material is fashioned from a synthetic resinous material.

7. The apparatus of claim 1, wherein said conveying means comprises a screw conveyor having a perforate lower housing, the screw conveyor cooperating with the perforate lower housing to permit pieces of ice having a size less than a predetermined minimum size to pass through the perforate lower housing into the tank means so as to precool water therein.

8. The apparatus of claim 1, wherein the orifices of the inverted "V" shaped portion of the chamber means are linearly arranged into two rows, each row supplying water to a corresponding one of the plate means outer surfaces.

9. Apparatus for making clear ice, comprising:

a plurality of ice plates each including, a pair of vertically oriented outer surfaces, the surfaces being generally planar and having an embossed pattern thereon, a passageway extending through the ice plate in a generally tortuous path, and having an inlet and an outlet, and a strip of synthetic resinous material provided along a lower portion of each ice plate;

distribution means for supplying water to the ice plates, including, a water chamber having a bottom, with a plurality of inverted "V" shaped portions, positioned vertically above the ice plates in close proximity thereto, each inverted "V" shaped portion corresponding to one of the ice plates and including a plurality of linearly arranged orifices providing a substantially uniform flow from the water chamber onto the outer surface of the corresponding ice plate, a tank provided below the ice plates for collecting excess water from the ice plates, and a pump having an inlet in communication with the tank, an outlet in communication with the water chamber and operable to supply water to the water chamber;

a rotating sizer provided between the ice plates and the tank for breaking ice slabs formed on the ice plates into pieces having a predetermined maximum size;

a perforate housing positioned between the rotating sizer and the tank;

a screw conveyor between the rotating sizer and the tank, cooperating with the perforate housing to convey ice pieces out of the apparatus, the perforate housing constructed so that ice pieces smaller than a predetermined minimum size pass through the housing into the tank to precool water therein; and refrigerating and defrosting means for supplying a refrigerant fluid to the ice plate passageways to cool the ice plates while forming ice slabs and to heat the ice plates to loosen ice slabs from the outer surfaces of the ice plates including, a compressor having an inlet and an outlet, a condenser having an inlet and an outlet, the condenser inlet being in fluid communication with the compressor outlet, conduit means for connecting the plate outlets with the compressor inlet, selectively operable for connecting the condenser outlet with the plate inlets during water freezing, and for connecting the compressor outlet with the plate inlets during ice slab loosening, a plurality of valves operable between open and closed positions, each valve corresponding to a respective ice plate and provided in the conduit means between the ice plate outlet and the compressor inlet immediately downstream of the ice plate outlet, each valve permitting a flow of refrigerant fluid through the respective ice plate when in the open position and preventing a flow of refrigerant fluid through the respective ice plate when in the closed position to increase pressure of the refrigerant fluid within the respective ice plate, and a bypass permitting communication between the compressor inlet and the compressor outlet so as to supply refrigerant fluid to the compressor inlet when each of the plurality of valves is in the closed position.

* * * * *